US010421095B2

(12) United States Patent
Bolyard, Jr. et al.

(10) Patent No.: US 10,421,095 B2
(45) Date of Patent: Sep. 24, 2019

(54) MODULAR FLUID APPLICATION DEVICE COMPATIBLE WITH DIFFERENT NOZZLE CONFIGURATIONS

(71) Applicant: Illinois Tool Works Inc., Glenview, IL (US)

(72) Inventors: Edward W. Bolyard, Jr., Old Hickory, TN (US); Mel Steven Lessley, Villa Hills, KY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 42 days.

(21) Appl. No.: 15/076,163

(22) Filed: Mar. 21, 2016

(65) Prior Publication Data

US 2016/0339469 A1 Nov. 24, 2016

Related U.S. Application Data

(60) Provisional application No. 62/164,405, filed on May 20, 2015.

(51) Int. Cl.
*B05C 5/02* (2006.01)
*B05B 1/02* (2006.01)
(Continued)

(52) U.S. Cl.
CPC ..... *B05C 5/0225* (2013.01); *B05C 5/02* (2013.01); *D04H 3/12* (2013.01); *B05C 11/1042* (2013.01)

(58) Field of Classification Search
CPC ..... B05C 5/02; B05C 5/0225; B05C 11/1042; B05C 5/0241; B05C 5/0254;
(Continued)

(56) References Cited

U.S. PATENT DOCUMENTS 4,687,137 A * 8/1987 Boger ..... B05C 5/001 118/315
4,891,249 A * 1/1990 McIntyre ..... B05B 7/0475 118/315

(Continued)

FOREIGN PATENT DOCUMENTS

CN 1378884 A 11/2002
EP 0936000 A2 8/1999
EP 1243342 A2 9/2002

OTHER PUBLICATIONS

International Search Report issued by ISA/EPO in connection with PCT/US2016/030580 dated Sep. 6, 2016.

(Continued)

*Primary Examiner* — Paul R Durand
*Assistant Examiner* — Andrew P Bainbridge
(74) *Attorney, Agent, or Firm* — Levenfeld Pearlstein, LLC

(57) ABSTRACT

A fluid application device includes one or more applicator heads. each applicator head includes a service block configured to receive a fluid from a fluid supply source, a manifold secured to the service block and configured to receive the fluid from the service block, the manifold having a seat, a module secured to the manifold at the seat, the module including a valve configured to selectively control flow of the fluid in the manifold, and a nozzle having a first configuration removably securable to the manifold, the nozzle configured to receive the fluid from the manifold, the nozzle having a first interface for interfacing with the manifold.

13 Claims, 3 Drawing Sheets

(51) Int. Cl.
*D04H 3/12* (2006.01)
*B05C 11/10* (2006.01)

(58) Field of Classification Search
CPC ..... B05C 11/026; D04H 3/12; B05B 1/02; B29C 65/4815; B29C 65/525
USPC ..... 222/394, 544; 425/72.2, 190, 192 S, 425/192 R
See application file for complete search history.

(56) References Cited

U.S. PATENT DOCUMENTS 4,949,668 A * 8/1990 Heindel ..... A61F 13/15642 118/314
4,983,109 A * 1/1991 Miller ..... A61F 13/15577 118/325
5,145,689 A * 9/1992 Allen ..... B05C 5/0279 425/145
5,294,258 A * 3/1994 Jarrell ..... B05C 5/0254 118/410
5,618,566 A * 4/1997 Allen ..... B05C 5/0279 264/12
5,728,219 A * 3/1998 Allen ..... B05C 5/001 118/300
6,540,831 B1 * 4/2003 Craine ..... A61F 13/00991 118/314
7,316,552 B2 * 1/2008 Haynes ..... D01D 4/025 425/7
7,438,544 B2 * 10/2008 Glawion ..... D01D 4/025 425/192 S
7,614,525 B2 * 11/2009 Saidman ..... B05C 5/001 222/146.2
9,126,222 B2 * 9/2015 McGuffey ..... B05C 5/0225
9,718,081 B2 * 8/2017 McGuffey ..... B05C 5/025
2005/0268845 A1 * 12/2005 Ganzer ..... B05C 5/0212 118/300
2005/0271806 A1 * 12/2005 Ganzer ..... B05C 5/0212 427/207.1
2009/0065611 A1 3/2009 Harris et al.
2012/0312838 A1 * 12/2012 Clark ..... B05C 5/0225 222/146.5
2017/0083029 A1 * 3/2017 Surenbrock ..... B05C 5/0279

OTHER PUBLICATIONS

International Preliminary Report on Patentability issued by ISA/EPO in connection with PCT/US2016/030580 dated Nov. 21, 2017.

* cited by examiner

MODULAR FLUID APPLICATION DEVICE COMPATIBLE WITH DIFFERENT NOZZLE CONFIGURATIONS

BACKGROUND

An adhesive application device may be used to apply an adhesive on either a strand or web of material. A common use for such an adhesive application device is in the manufacture of products that include nonwoven fabrics. Nonwoven fabrics are engineering fabrics that provide specific functions such as absorbency, liquid repellence, resilience, stretch, softness, strength, flame retardant protection, easy cleaning, cushioning, filtering, use as a bacterial barrier and sterility. In combination with other materials, nonwoven materials can provide a spectrum of products with diverse properties and can be used alone or as components of hygiene apparel including disposable hygiene products, or as home furnishings, health care, engineering, industrial and consumer goods, for example.

Some nonwoven products include a plurality of elasticated strands positioned on and bonded to the nonwoven materials to, for example, allow for flexibility fitting around an object or a person. The strands may be bonded to the nonwoven fabric with the adhesive, such as glue, applied by the adhesive application device. In one configuration, the strands are fed past a nozzle on the adhesive application device. The nozzle may include a plurality of outlets through which the glue may be discharged onto the strand. The glue-coated strand may then be applied on the web. Alternatively, the adhesive may be applied to a web, and the strands may be applied on the glue-coated web.

The adhesive application device may be used with different nozzles depending on the medium to which the adhesive is being applied, i.e., a stand or web, and desired application characteristics, including application pattern or volume. For example, an adhesive application device may apply the glue to the strands with either a contact nozzle or a non-contact nozzle. A contact nozzle discharges a volume of substantially stationary glue while a substrate, such as the strand, is fed by the glue and receives the glue thereon. In a non-contact nozzle, the glue may be discharged from an outlet as a fiber or spray. The glue is discharged over a gap between the outlet and the strand or web. Discharging of the glue fiber or spray may be controlled by a second fluid, such as air, discharged from adjacent outlets, to oscillate the glue fiber during application onto the strand or web.

However, an adhesive application device is typically associated with only a single nozzle type. Thus, multiple adhesive application devices are typically used where different application characteristics or different mediums (i.e., strands or webs) are involved that would require different nozzle types.

Some adhesive application devices include nozzles that may be replaced with different types of nozzles. However, each type of nozzle is typically associated with a specific adapter or module having associated valves and/or fluid manifolds for delivering fluid to the nozzle. Thus, to switch between different types of nozzles, the adapter or module, and/or the manifold must be replaced as well. A service block typically needs to be replaced to accommodate a different nozzle type as well. This process involves additional labor and time, and also requires a manufacturer to keep additional parts and replacements on hand.

Accordingly, it is desirable to provide a fluid application device to which nozzles of different configurations may be interchangeably attached to and removed from.

SUMMARY

According to one aspect, there is provided a fluid application device having one or more applicator heads. Each applicator head includes a service block configured to receive a fluid from a fluid supply source, a manifold secured to the service block and configured to receive the fluid from the service block, the manifold having a seat, a module secured to the manifold at the seat, the module including a valve configured to selectively control flow of the fluid in the manifold, and a nozzle having a first configuration removably securable to the manifold, the nozzle configured to receive the fluid from the manifold, the nozzle having a first interface for interfacing with the manifold, the manifold configured for receipt of nozzles having different configurations.

According to another aspect there is provided an applicator head for a fluid application device. The applicator head includes a service block configured to receive a fluid from a fluid supply source, a manifold secured to the service block and configured to receive the fluid from the service block, the manifold having a seat, a module secured to the manifold at the seat, the module including a valve configured to selectively control flow of the fluid in the manifold, and a nozzle having a first configuration removably securable to the manifold, the nozzle configured to receive the fluid from the manifold, the nozzle having a first interface for interfacing with the manifold.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
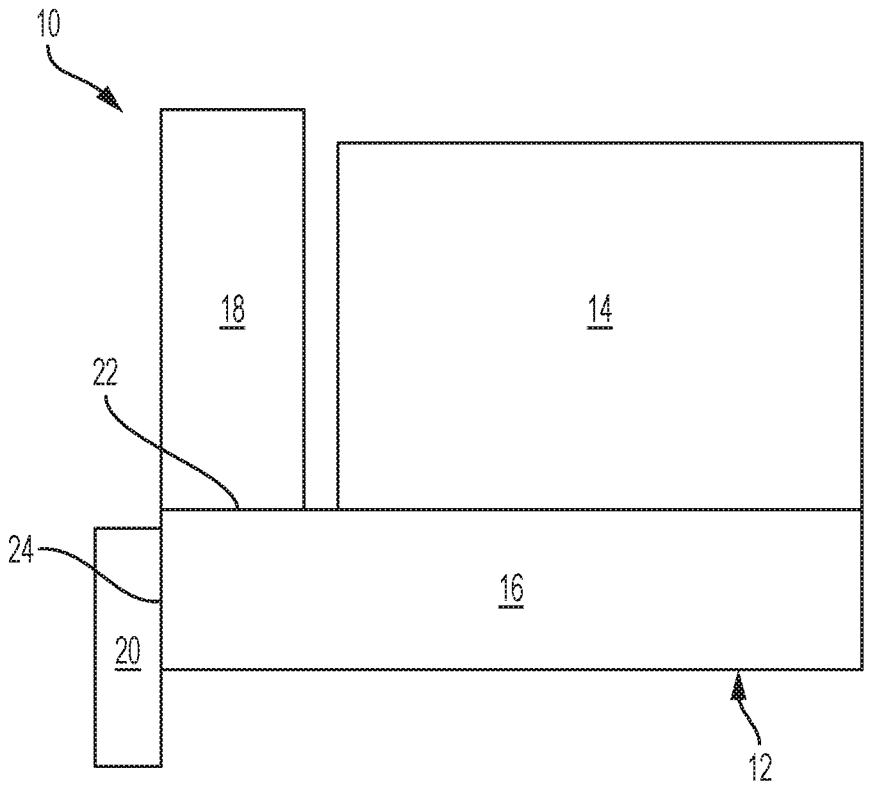
FIG. 1 is a schematic diagram representing a fluid application device according to an embodiment described herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

A fluid application device 10 according to the embodiments described herein may include one or more applicator heads 12. FIG. 1 is a schematic diagram of an applicator head 12 with interchangeable nozzle types according to an embodiment described herein. Referring to FIG. 1, the applicator head 12 generally includes a service block 14, a manifold 16, a module 18 and a nozzle 20.

The service block 14 is configured to receive a fluid. The fluid may be a viscous fluid that is a liquefied material heated or non-heated between 10 and 50,000 centipoise (cps). The fluid may be, for example, an adhesive, such as a hot melt adhesive. The service block 14 is connected to a fluid supply by a hose or similar conduit. Thus, the fluid supply may be positioned remote from the applicator head 12 and supply the fluid thereto via the hose or similar conduit.

The manifold 16 is secured to and configured to receive the fluid from the service block 14. The manifold 16 may be secured to the service block 14 using known suitable fasteners, such as bolts, screws or the like. The manifold 16 extends beyond a first end of the service block 14 and includes a seat 22 to which the module 18 may be attached. In one embodiment, the manifold 16 is secured to the service block 14 generally at an underside of the service block 14 and extends beyond a front end of the service block 14. As detailed below, in some embodiments, the manifold 16 may include positioning features for proper positioning relative to the service block 14.

The module 18 is secured to the manifold 16 with known, suitable fasteners, such as bolts, screws or the like. As described further below, the module 18 includes valve components to control flow of the fluid in the manifold 16 to the nozzle 20.

The nozzle 20 is positioned in fluid communication with the manifold 16 and removably secured to the manifold 16 with suitable, known fasteners, such as bolts or screws. The nozzle 20 may be either a contact or non-contact type nozzle for discharging the fluid onto a substrate, such as a strand or web (not shown). The nozzle 20 may be a laminated plate nozzle (LPN) comprising a plurality of plates secured together having one or more fluid flow paths defined therein between an inlet to receive the fluid from the manifold 16 and an outlet or orifice to discharge the fluid. As described further below, the nozzles of different types or configurations, i.e., the contact and non-contact nozzles, of the present application, each include an interface 24 for interfacing with the manifold 16. The interface 24 is the same across the different nozzle types. Thus, in the embodiments described herein, nozzles of different types or configurations may be secured to and used interchangeably with the manifold 16.

Figure 2:
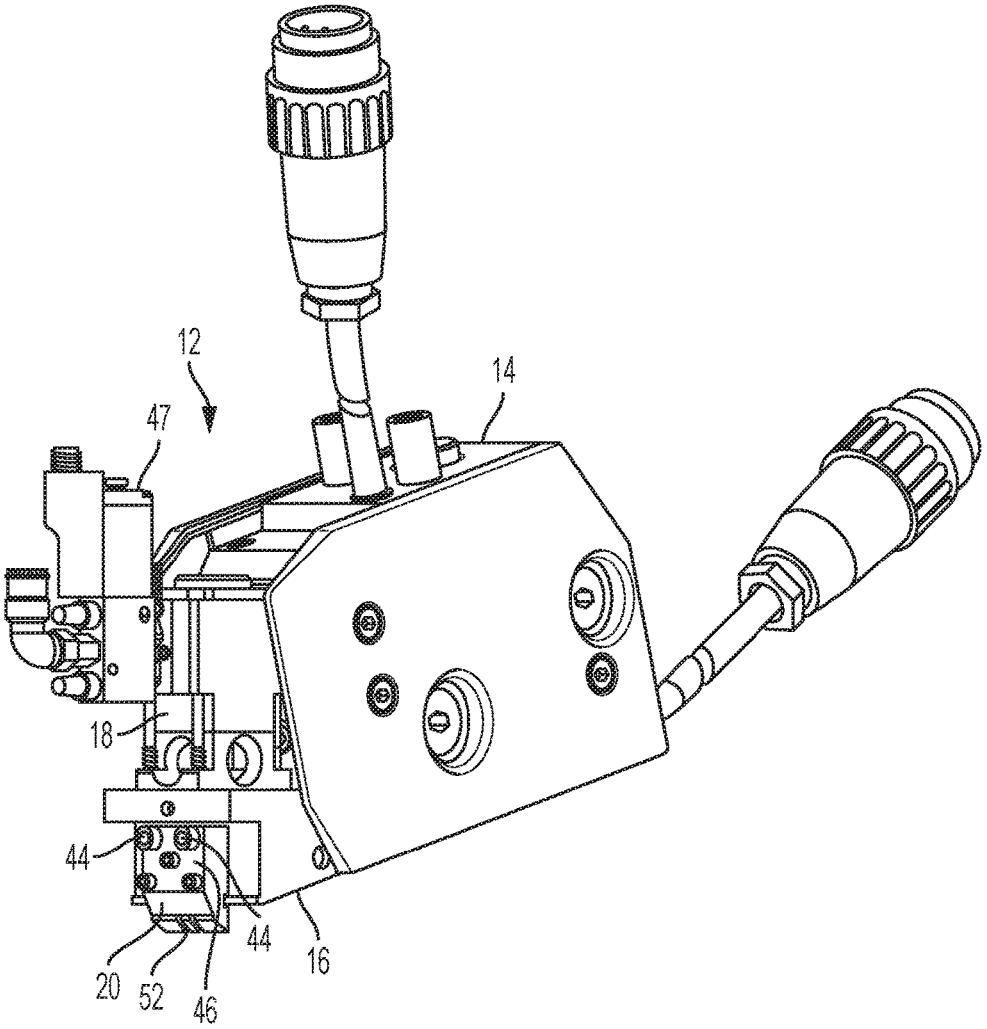
FIG. 2 is a perspective view of a fluid application device according to an embodiment described herein.
Figure 3:
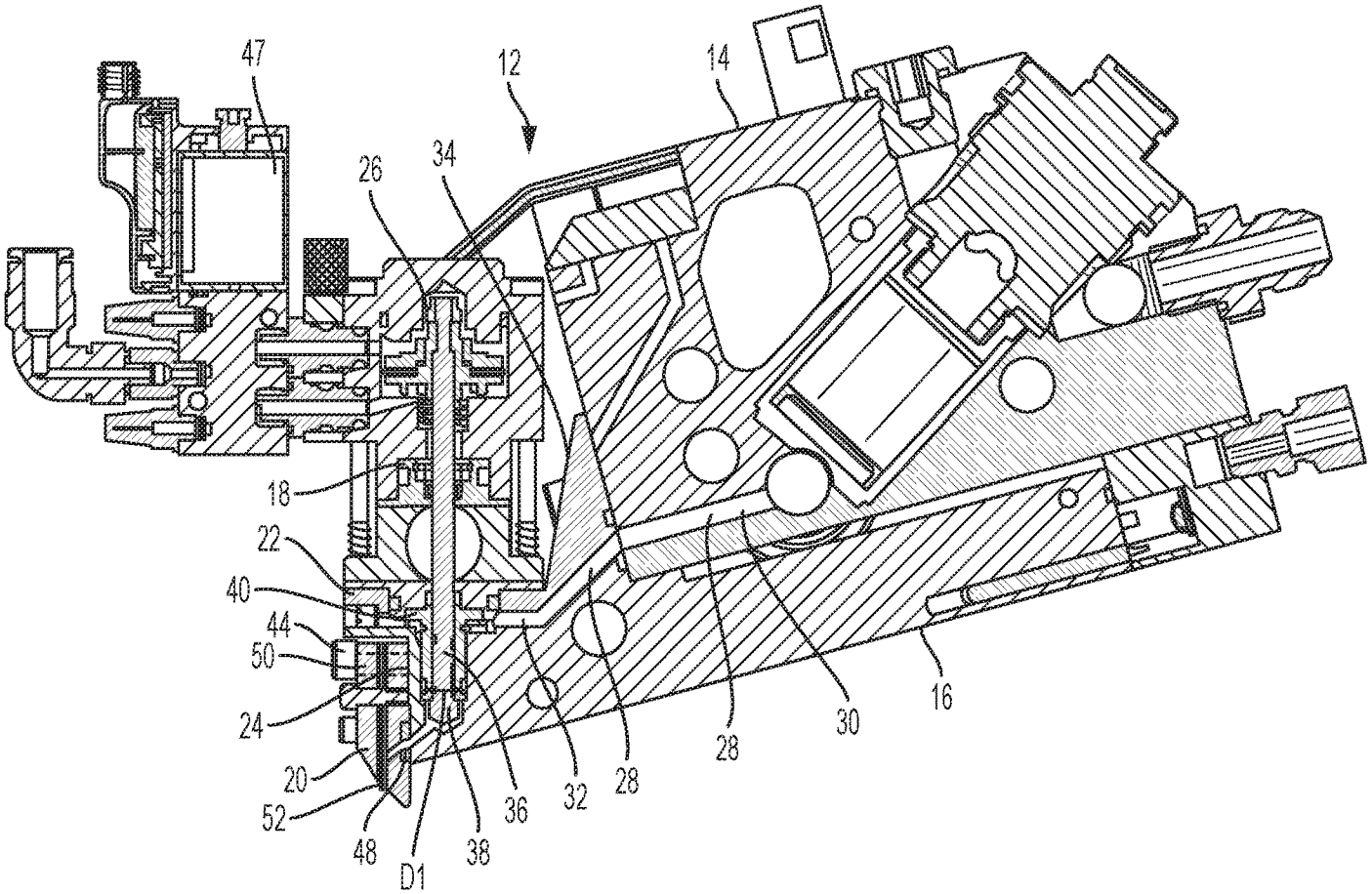
FIG. 3 is cross-sectional view of fluid application device of FIG. 2.

FIG. 2 is a perspective view of an applicator head 12 of a fluid application device according to one embodiment. FIG. 3 is a cross-sectional view of the applicator head 12. Referring to FIGS. 2 and 3, a fluid flow path 28 is defined in the service block 14 and manifold 16 for delivering the fluid the nozzle 20. The module 18 includes a valve 26 disposed in the flow path 28. The flow path 28, in one embodiment, is defined by a first fluid conduit 30 in the service block 14 and a second fluid conduit 32 in the manifold 16.

The manifold 16 is removably secured to the service block 14 to facilitate repair, replacement or substitution of manifold 16 as desired. In one embodiment, the manifold 16 includes a flange 34 configured to abut the service block 14. A portion of the flow path 28, i.e., the second fluid conduit 32 may extend in the flange 34. In addition, the flange 34 may serve as a positioning element to properly the position the manifold 16 relative to the service block 14.

The seat 22 of the manifold 16 is formed, in part, as a recess in the manifold 16 configured to receive at least a portion 36 of the module 18. In one embodiment, the module 18 includes the valve 26, and the portion 36 of the module 18 received in the seat 22 is a portion of the valve 26. For example, as shown in FIG. 3, a valve stem 38 and a valve member 40 driven by the valve stem 38 may be positioned in the seat 22 to control fluid flow in the manifold 16 to the nozzle 20.

The nozzle 20 is removably secured to the manifold 16 with one or more suitable fasteners. In one embodiment, the nozzle 20 is secured to the manifold 16 with two fasteners 44, such as bolts, laterally spaced from one another. The fasteners 44 extend through the nozzle 20 and into respective bores in the manifold 16. The seat 22 of the manifold extends between the spaced apart bores of the manifold 16. Thus, in use, the portion of the module 18, e.g., a portion of a valve 26, positioned on the seat 22, extends between the fasteners 44 positioned in the bores in the manifold 16. Accordingly, a shown in FIG. 3, a portion of the valve 26, i.e., the valve stem 38 and a valve member 40 driven by the valve stem 38 are positioned behind the nozzle 20 in the manifold 16.

In one embodiment, the nozzle has a width of approximately 25 mm measured across a front face 46. The fasteners 44 are spaced apart by a first distance, as are the corresponding bores in the manifold 16. To be positioned between the bores, the valve stem 38 and valve member 40 must be sized accordingly. In one embodiment, the seat 22 has a diameter D1 of about 8 mm, which generally corresponds to a diameter of the valve stem 38 and valve member 40. It is understood that the present disclosure is not limited to these dimensions, however.

In addition to the valve components, the module 18 may also include a heater to pre-heat air or another second fluid that may be used to assist application of the fluid. In one embodiment, similar to the nozzle 20, the module 18 may have a width of approximately 25 mm, but is not limited thereto. The valve 26 of the module 18 may be driven by a solenoid 47 that may be quick-mounted either to the front or the top of the module 18.

The nozzle 20 includes the interface 24 on a side facing the manifold 16. The interface 24 includes, for example, an inlet opening 48 configured to receive the fluid from the manifold 16 and fastener openings 50 through which fasteners 44 extend into the bores of the manifold. The inlet opening 48 is part of a nozzle conduit that extends substantially in a single linear direction from the inlet opening 48 to a discharge orifice 52 in the nozzle 20. The interface 24 of the nozzle corresponds to a face of the manifold 16 to which in the nozzle 20, such that the inlet opening 48 is aligned with the second conduit 32 of the manifold 16, and the fastener openings 50 are aligned with the bores of the manifold 16.

Accordingly, different nozzles having different configurations, may be used in the applicator head 12 described herein so long as the different nozzles have an interface 24 with a common configuration that corresponds to the manifold 12. For example, a first nozzle may have a first configuration, such as a non-contact nozzle configuration, to discharge the fluid over a gap onto a substrate. The non-contact nozzle may discharge a second fluid, such as air, to control a pattern in which the fluid, e.g., adhesive, is discharged and applied to the substrate. A second nozzle may have a second configuration different from the first configuration, such as a contact nozzle configuration to discharge fluid directly onto the substrate. Both the first and second nozzles have the same interface 24, and thus, may be interchangeably secured to and fluidically connected with the manifold 16.

In addition, because of the positioning on the module 18, namely, the positioning of the valve stem 38 and valve member 40, together with the nozzle 20 being secured to the manifold 16, nozzles of different configurations may be used interchangeably with the same manifold 16, module 18, and service block 14. Moreover, in the embodiments above, the module 18 may be removed or replaced without disturbing the nozzle 20. The applicator head 12 may further include flow dividers to control a volume of fluid delivered to the nozzle.

Accordingly, in the embodiments above, a fluid application device 10, and in particular, and applicator head 12 of a fluid application device may be converted between, for example, spray, strand coating and slot configurations by interchangeably securing different nozzle types or configurations, i.e., contact and non-contact type nozzles, to the manifold 16, without substituting the module 18, manifold 16 or service block 14. The applicator head 12 of the embodiments above may be used to apply the fluid to a substrate travelling between about 500 meters per minute (mpm) and 700 mpm.

In a further embodiment, the nozzle 20 of the applicator head 12 may be a die-slot extruder type nozzle. To use this type of nozzle in the applicator head 12, the manifold 16 may be removed from the service block 14 and replaced with a die-slot extruder compatible type manifold, while the module 18 and service block 14 remain. Alternatively, an adapter may be secured to the existing manifold 16 that may be used with a die-slot extrude type nozzle.

The fluid application device described in the embodiments above may be used to apply a fluid, such as an adhesive onto a strand of material or a substrate. Such an application may be useful in the manufacture of nonwoven products. However, the present disclosure is not limited to this application. It is understood that the fluid application device described herein may be used in other applications as well, for example, packaging.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A fluid application device comprising one or more applicator heads, each applicator head comprising:

a service block comprising a body having a first fluid conduit extending therein configured to receive a fluid from a fluid supply source;

a manifold secured to the service block and comprising a manifold body having a second fluid conduit extending therein configured to receive the fluid from the first fluid conduit of the service block, the manifold having a seat;

a module secured to the manifold at the seat, the module including a valve configured to selectively control flow of the fluid in the manifold; and a nozzle having a first configuration removably securable to the manifold, the nozzle configured to receive the fluid from the manifold, the nozzle having a first interface for interfacing with the manifold, the manifold configured for receipt of nozzles having different configurations, wherein the manifold body includes an upper surface extending along an underside of the service block and further includes a flange extending from the upper surface, the upper surface and the flange configured to position the manifold body relative to the service block such that the first fluid conduit is disposed in fluid communication with the second fluid conduit.

2. The fluid application device of claim 1, further comprising a nozzle of a second configuration, different from the first configuration, removably securable to the manifold, the nozzle of the second configuration having the first interface for interfacing with the manifold, wherein the nozzle of the first configuration and the nozzle of the second configuration are interchangeably securable to the manifold.

3. The fluid application device of claim 2, wherein one of the nozzle having the first configuration and the nozzle having the second configuration is secured to the manifold.

4. The fluid application device of claim 1, wherein the seat includes a recess in the manifold configured to receive a portion of the module such that the portion of the module is positioned behind the nozzle.

5. The fluid application device of claim 4, wherein the portion of the module includes a valve stem.

6. The fluid application device of claim 4, wherein the nozzle is secured to the manifold by two laterally spaced apart fasteners extending through respective fastener openings of the nozzle and into respective fastener bores of the manifold, and the portion of the module extends between the two fasteners in the manifold.

7. An applicator head for a fluid application device, the applicator head comprising:

a service block comprising a body having a first fluid conduit extending therein configured to receive a fluid from a fluid supply source;

a manifold secured to the service block and comprising a manifold body having a second fluid conduit extending therein configured to receive the fluid from the first fluid conduit of the service block, the manifold having a seat;

a module secured to the manifold at the seat, the module including a valve configured to selectively control flow of the fluid in the manifold; and a nozzle having a first configuration removably securable to the manifold, the nozzle configured to receive the fluid from the manifold, the nozzle having a first interface for interfacing with the manifold, wherein the manifold body includes an upper surface extending along an underside of the service block and further includes a flange extending from the upper surface for positioning the manifold body relative to the service block such that the first fluid conduit is disposed in fluid communication with the second fluid conduit, and wherein the second fluid conduit extends within the flange, and the flange is configured to abut a front face of the service block such that the second fluid conduit within the flange is configured to receive the fluid discharged from the first fluid conduit at the front face of the service block.

8. The applicator head of claim 7, further comprising a nozzle of a second configuration, different from the first configuration, removably securable to the manifold, the nozzle of the second configuration having the first interface for interfacing with the manifold, wherein the nozzle of the first configuration and the nozzle of the second configuration are interchangeably securable to the manifold.

9. The applicator head of claim 8, wherein one of the nozzle having the first configuration and the nozzle having the second configuration is secured to the manifold.

10. The applicator head of claim 7, wherein the seat includes a recess in the manifold configured to receive a portion of the module such that the portion of the module is positioned behind the nozzle.

11. The applicator head of claim 10, wherein the portion of the module includes a valve stem.

12. The applicator head of claim 10, wherein the nozzle is secured to the manifold by two laterally spaced apart fasteners extending through respective fastener openings of the nozzle and into respective fastener bores of the manifold, and the portion of the module extends between the two fasteners in the manifold.

13. An applicator head for a fluid application device, the applicator head comprising:

a service block configured to receive a fluid from a fluid supply source, the service block having a first fluid conduit for flow of the fluid, a support side and a front face adjacent to the support side;

a manifold secured to the support side of the service block, the manifold having a second fluid conduit formed therein and a seat formed on a portion of the manifold extending beyond the front face of the service block, the second fluid conduit configured to receive the fluid from the first fluid conduit of the service block;

a module secured to the manifold at the seat with a first fastener, the module including a valve configured to selectively control flow of the fluid in the manifold; and a nozzle having a first configuration removably securable to the manifold, the nozzle configured to receive the fluid from the manifold, the nozzle having a first interface for interfacing with the manifold, wherein the nozzle is secured to the manifold with one or more second fasteners extending through the nozzle and into respective bores in the manifold.

* * * * *